US011659966B2

(12) United States Patent
Green et al.

(10) Patent No.: US 11,659,966 B2
(45) Date of Patent: May 30, 2023

(54) SHEET PRODUCT DISPENSER

(71) Applicant: Kimberly-Clark Worldwide, Inc., Neenah, WI (US)

(72) Inventors: Jonathan Green, Ossett (GB); Michiel de Haan, Leiden (NL); Freerk van Oudheusden, Leiden (NL)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 17/290,533

(22) PCT Filed: Oct. 31, 2018

(86) PCT No.: PCT/US2018/058560

§ 371 (c)(1),
(2) Date: Apr. 30, 2021

(87) PCT Pub. No.: WO2020/091772

PCT Pub. Date: May 7, 2020

(65) Prior Publication Data

US 2021/0315427 A1 Oct. 14, 2021

(51) Int. Cl.
*A47K 10/38* (2006.01)

(52) U.S. Cl.
CPC .. *A47K 10/3836* (2013.01); *A47K 2010/3881* (2013.01)

(58) Field of Classification Search
CPC ..... A47K 10/3818; A47K 10/44; A47K 2010/3206
See application file for complete search history.

(56) References Cited

U.S. PATENT DOCUMENTS 6,575,397 B1 6/2003 Tramontina et al.
7,287,720 B1 * 10/2007 Allegre ..... A47K 10/38 242/593
2002/0056718 A1 * 5/2002 Paukov ..... A47K 10/3818 221/63
2003/0111480 A1 6/2003 Lewis et al.
2009/0045211 A1 * 2/2009 Friesen ..... A47K 10/3818 221/45
2011/0233255 A1 9/2011 Tiamson
(Continued)

FOREIGN PATENT DOCUMENTS

WO 2010141931 A2 12/2010
WO 14058323 A1 4/2014
WO 18063219 A1 4/2018

*Primary Examiner* — Timothy R Waggoner

(57) ABSTRACT

A dispenser comprising a body, a dispensing device having an orifice, a gate configured to move between a first position and a second position with respect to the orifice, a biasing device to bias the gate towards the first position, and a dampener coupled to the gate and configured to impede the biasing device from biasing the gate towards the first position to delay, in time, the gate from moving from the second position to the first position; and wherein in the first position the gate engages the sheets passing through the orifice with enough force to break a perforation separating two contiguous sheets of the series to cause single sheet dispensing; and the delay allows multiple sheets of the series of interconnected sheets to pass through the orifice, when pulled at a given rate, before the gate moves from the second position to the first position.

18 Claims, 7 Drawing Sheets

(56) References Cited

U.S. PATENT DOCUMENTS

| | | | | |
|---|---|---|---|---|
| 2013/0043266 | A1* | 2/2013 | Hagleitner | A47K 10/36<br>221/26 |
| 2017/0290471 | A1 | 10/2017 | Borke et al. | |
| 2018/0206684 | A1 | 7/2018 | Tedesco et al. | |

* cited by examiner

SHEET PRODUCT DISPENSER

TECHNICAL FIELD

This disclosure generally relates to dispenser for dispensing paper products.

BACKGROUND OF THE DISCLOSURE

Systems dispensing consumable products are ubiquitous in many environments today. For example, rolled towel and wipe dispensers are commonplace in private, semi-private and public washrooms, and kitchens and break rooms. Many such dispensers use sheets of paper in hard roll form with each sheet separated from the other by a perforation such that as each sheet is pulled from the dispenser the dispenser opening causes the sheet to break along the perforations to allow single sheet dispensing. However, if multiple sheets are needed the user must perform this same process, which results in multiple separate sheets when multiple connected sheets may be desired, e.g., to clean up a large spill.

SUMMARY OF THE DISCLOSURE

In general, the subject matter of this specification relates to a paper product dispenser for perforated roll-based dispensing. One aspect of the subject matter described in this specification can be implemented in systems that include a dispenser for dispensing rolled product having a series of interconnected sheets separated by perforations, the dispenser comprising a body having a product holding area for holding the rolled product; a dispensing device having an orifice defining an opening in the body to the product holding area, a gate configured to move between a first position and a second position with respect to the orifice, a biasing device configured to bias the gate towards the first position, and a dampener coupled to the gate and configured to impede the biasing device from biasing the gate towards the first position to delay, in time, the gate from moving from the second position to the first position; and wherein in the first position the gate frictionally engages the series of interconnected sheets passing through the orifice with enough force to break a perforation separating two contiguous sheets of the series to cause single sheet dispensing; and the delay allows multiple sheets of the series of interconnected sheets to pass through the orifice, when pulled at a given rate, before the gate moves from the second position to the first position. Other embodiments of this aspect include corresponding methods and apparatus.

Another aspect of the subject matter described in this specification can be implemented in methods that include moving a gate between a first position and a second position, with respect to an orifice defining an opening in a dispenser body, by overcoming a biasing device biasing the gate towards the first position; and releasing the gate at the second position to allow the gate to return to the first position, wherein the gate's return to the first position is delayed by a dampener coupled to the gate. Other embodiments of this aspect include corresponding systems and apparatus.

Particular embodiments of the subject matter described in this specification can be implemented so as to realize one or more of the following advantages. For example, the dispenser allows the user to remove one sheet at-a-time from the roll or stream multiple, connected, sheets from the roll, in either case without having to use two hands to separate the sheet(s) from the roll. In this way the user can easily select and switch between pulling one sheet at-at-time and pulling multiple sheets at-a-time as the need for the sheet(s) dictates.

When inserting a roll into a typical dispenser, the user must thread the first sheet (or first several sheets) through the center of the dispensing orifice/opening, which can be a delicate and challenging process. In some implementations, the dispenser described herein allows a user to engage the roll sheets to the orifice by allowing the user to pull the sheets through the side of the dispenser along a guide path. This side access to the orifice of the dispenser permits easy loading of a roll into the dispenser, e.g., as is needed to refill the dispenser with a new roll when the previous roll is depleted.

The details of one or more implementations of the subject matter described in this specification are set forth in the accompanying drawings and the description below. Other features, aspects, and advantages of the subject matter will become apparent from the description, the drawings, and the claims.

Figure 1A:
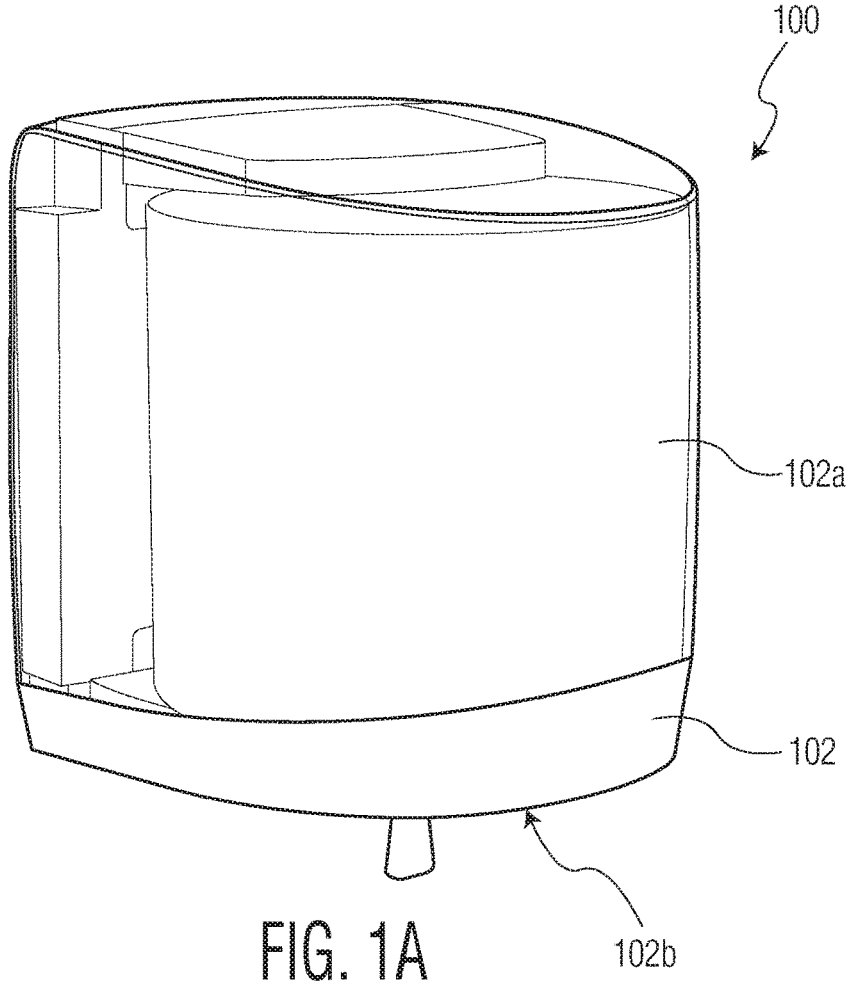
FIG. 1A is a representation of an example product dispenser.

Repeat use of reference characters in the present specification and drawings is intended to represent the same or analogous features or elements of the disclosure.

DETAILED DESCRIPTION OF THE DISCLOSURE

The present disclosure generally relates to a rolled product dispenser that provides single sheet (e.g., one at a time) and multiple, interconnected sheet dispensing from a roll, e.g., a hand towel, wipes/wipers, bath tissue roll, while allowing single hand tearing of the sheet/sheets from the remainder of the roll.

More particularly, the dispenser includes an opening or orifice through which the sheets are pulled for dispensing. The dispenser also includes a gate that moves between first and second positions. When the gate is in the first position the gate and orifice frictionally engage any sheets drawn through the orifice such that the frictional force is sufficient to break the perforations between the sheets to enable sheet-by-sheet dispensing (i.e., single sheet dispensing). The gate is biased towards (and held in) the first position by a biasing device such as a spring.

In the event a user desires multiple interconnected sheets (i.e., a continuous stream of sheets not separated from each other) the user moves the gate to the second position. In the second position the gate and orifice do not apply sufficient frictional force to the sheets to break the inter-sheet perforations as the sheets are drawn through the orifice. When the user lets go of the gate the spring draws the gate back towards the first position. This return to the first position is slowed by a dampener coupled to the gate that resists (but does not overcome) the biasing effect of the biasing device. As such, the gate returns to the first position at a slower rate as compared to its return without the dampener. The delay caused by the dampener allows a user to pull multiple sheets through the orifice before the gate reaches the first position. In this way the user can control whether the dispenser operates in single sheet or multi-sheet dispensing modes.

FIG. 1A is a representation of an example product dispenser 100. The dispenser 100 can be, for example, a hand towel dispenser 100, a wiper or wiper dispenser 100, a bath tissue dispenser 100, or the like for rolled paper products. Paper products describes sheet materials made from cellulose fibers (e.g., wood pulp), synthetic fibers (e.g., polypropylene) or some combination thereof, and include, for example, paper towels, bath tissue, and wipers. A rolled product is an interconnected sheet product that is wound around a core (or center axis), and a center pull product is a rolled product that is unwound from its core outward towards its periphery.

Figure 1B:
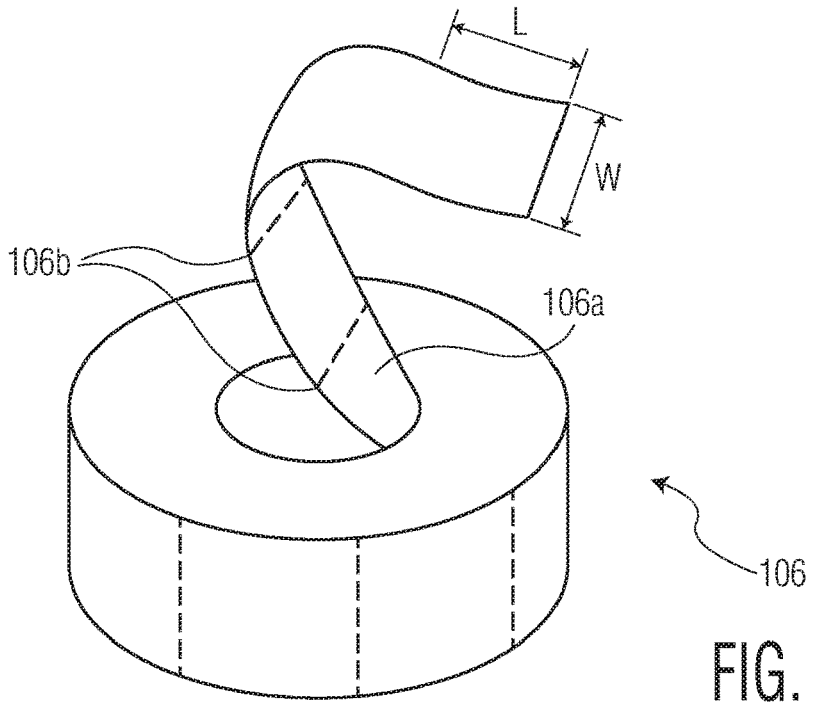
FIG. 1B is a representation of an example roll of paper product.

FIG. 1B is a representation of an example roll of paper product 106 (e.g., a rolled paper product that is center pulled). The paper product 106 includes a plurality of product sheets 106*a* separated by perforations 106*b*. As described below in greater detail, the perforations 106*b* have a break force, which is exceeded when the product 106 is pulled through the dispenser 100 in a dispense operation to separate, one-by-one, the sheets 106*a* for single sheet dispensing (when in the gate is in the first position as described below). The sheets 106*a* are pulled through the dispenser 100 and dispensed along the axis parallel to their length L.

Figure 1C:
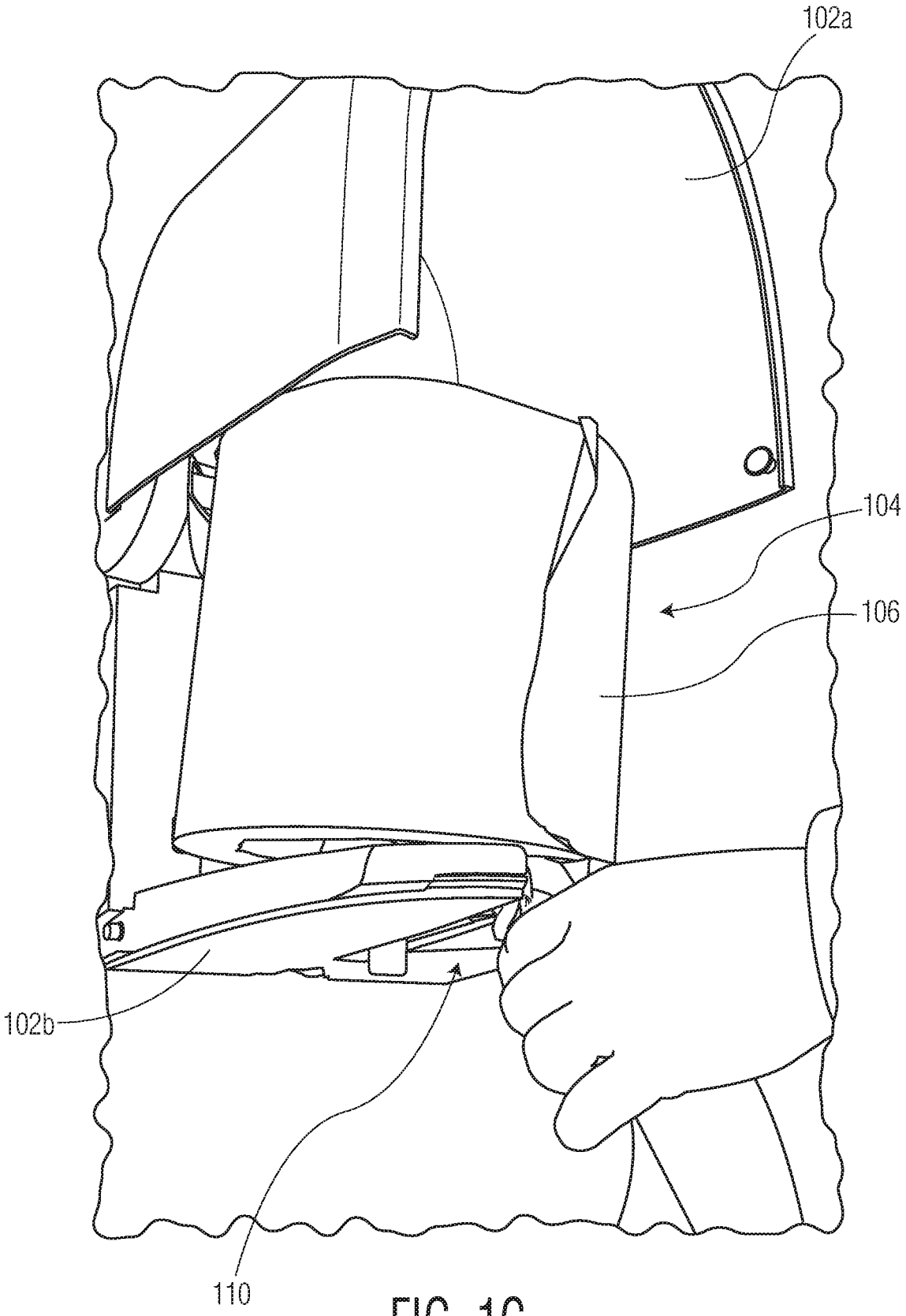
FIG. 1C is a representation of the example dispenser with the front cover in an open position.

The dispenser 100 includes a body 102, e.g., a composite or metal housing or a combination thereof, with an outer surface (e.g., an exterior surface of the body 102). The dispenser 100 also includes a product holding area 104 to hold paper product 106, as shown in FIG. 1C, which is a representation of the example dispenser 100 with the front cover 102*a* in an open position (the front cover 102*a* is in a closed position in FIG. 1A).

In some implementations, the product holding area 104 is a space or cavity within the body 102 in which the product 106 can be positioned for dispensing, and can be accessed by, for example, rotating or pivoting the front cover 102*a*, from a closed position, away from the back cover (e.g., the portion of the cover 102 mounted to or proximate the mounting surface, for example, a wall) by a hinge or the like to an open position. For example, the front cover 102*a*, when in the closed position, the back cover and the bottom side 102*b* of the dispenser 100 define the product holding area 104.

Figure 2A:
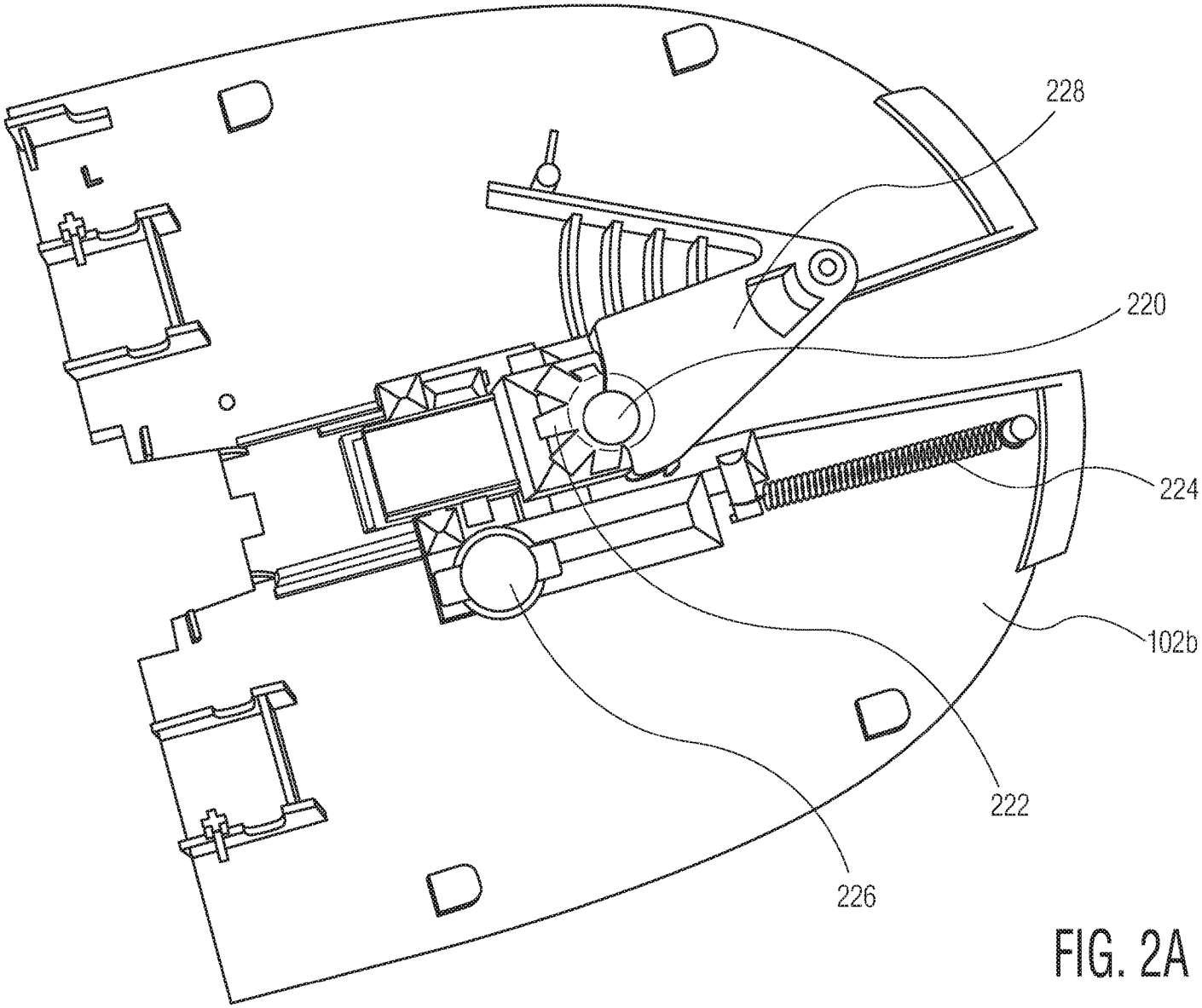
FIG. 2A is a cutaway representation of the dispensing device including the gate in a first position.
Figure 2B:
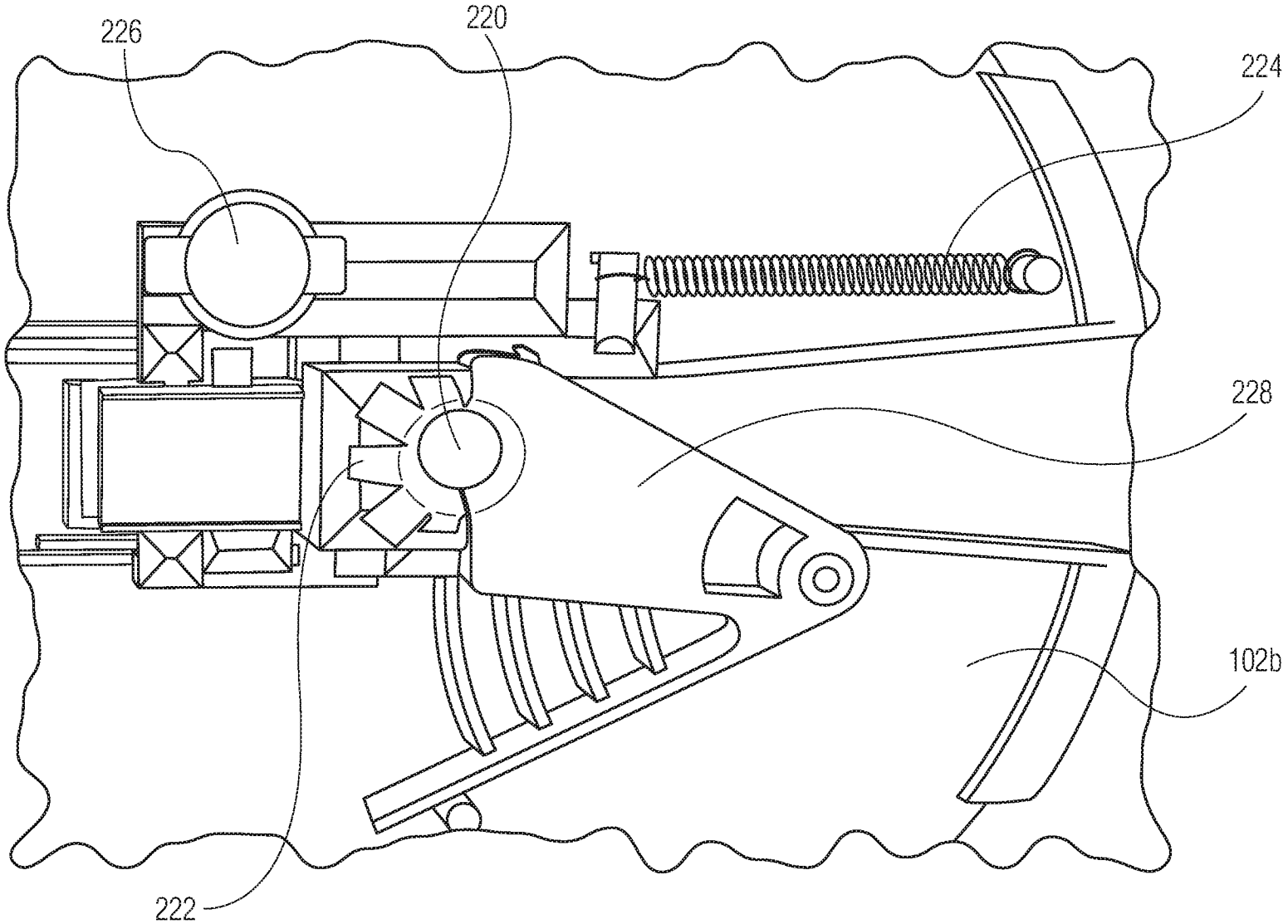
FIG. 2B is a detail view of another implementation of the dispensing device.
Figure 2C:
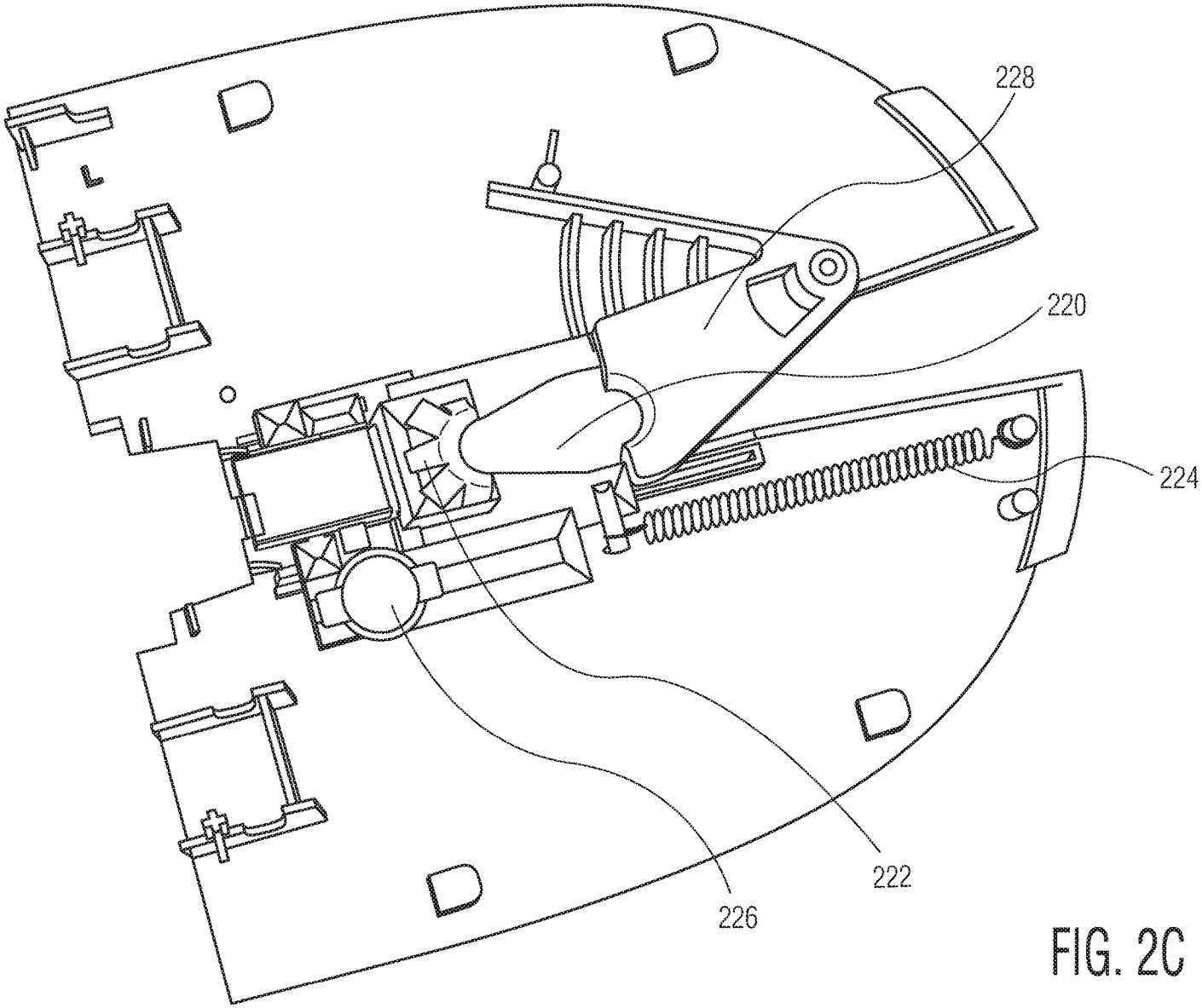
FIG. 2C is a cutaway representation of the dispensing device including the gate in a second position.
Figure 2D:
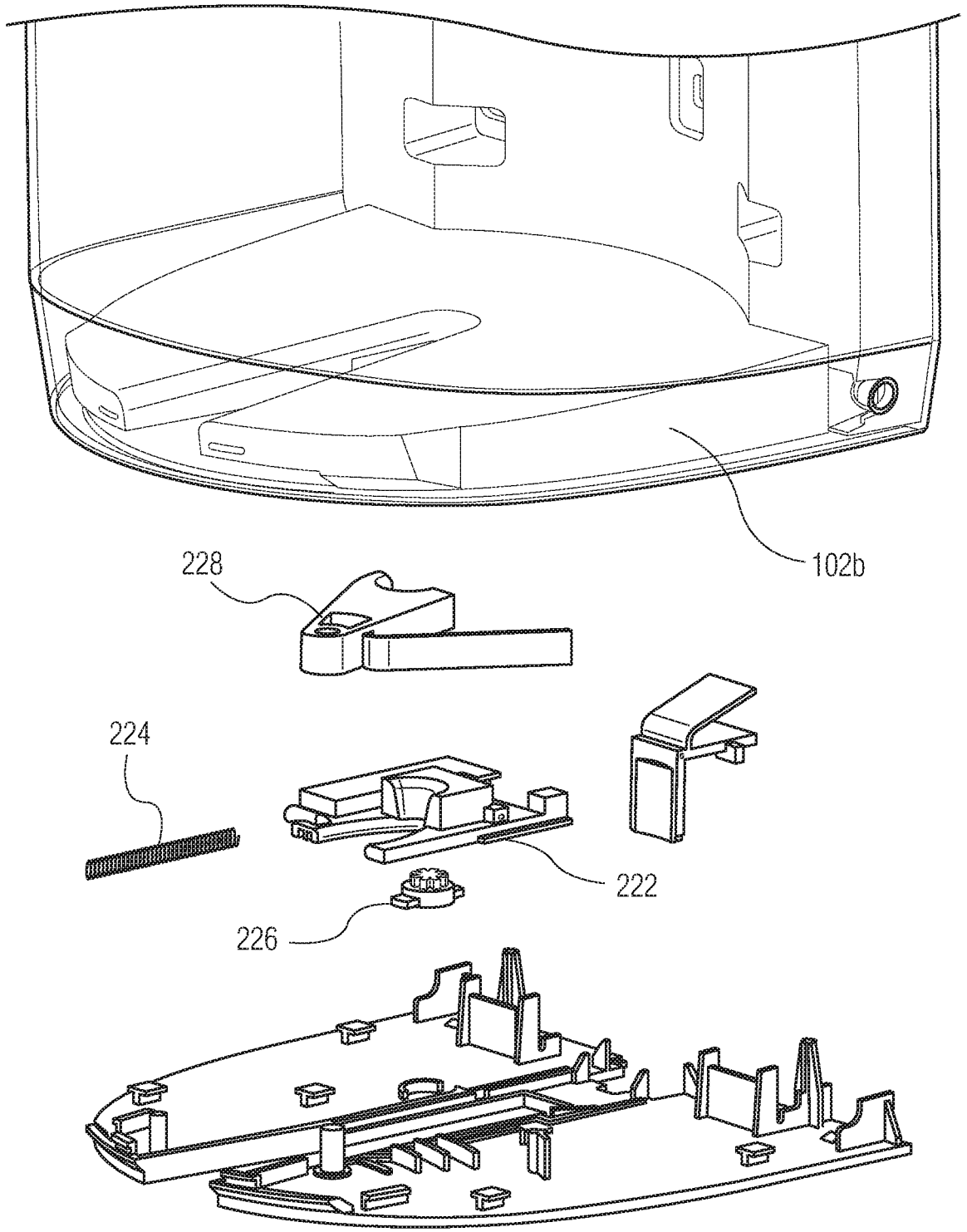
FIG. 2D is an exploded view of the dispensing device.

The dispenser 100 also includes a dispensing device 110, which operates to facilitate dispensing product 106, as described, for example, with reference to FIGS. 2A, 2B, 2C and 2D. FIG. 2A is a cutaway representation of the dispensing device 110 including the gate 202 in a first position, FIG. 2B is a detail view of another implementation of the dispensing device 110, FIG. 2C is a cutaway representation of the dispensing device 110 including the gate 202 in a second position, and FIG. 2D is an exploded view of the dispensing device 110.

In some implementations the dispensing device 110 is located at or proximate the bottom side 102*b* of the dispenser 100. More generally, in implementations for a center pull rolled product, the dispensing device 110 is located proximate the core of the product 106 when the product 106 is positioned in the dispenser 100 for dispensing. In some implementations, the dispensing device 110 is positioned to align with and be proximate the center axis of the product 106, e.g., aligned to the axis centered through the length of the open core of the rolled product 106. In other implementations, the dispensing device 110 can be positioned anywhere on the front cover 102*a*, back cover or sides of the dispenser 100, e.g., proximate the periphery of the roll 106. For example, for a rolled product 106 that unwinds from its periphery, the dispensing device 110 is positioned on the front cover 102*a*. In either configuration the dispensing device 110 provides an opening, through an orifice 220, in the dispenser 100 through which the product 106 can be moved from the product holding area 104 to a region external to the dispenser 100 (e.g., through the outer surface) for access and use by a user.

The dispensing device 100 includes a gate 222 moveable between a first position (as shown in FIG. 2A) and a second position (as shown in FIG. 2C), for example, with respect to the orifice 220 as shown in FIG. 2A. In some implementations, the gate 222 slides along a track (or other guide system or path) on the dispenser 100 that allows the gate 222 to move back and forth between the first and second positions, which changes the size of the orifice 220. The orifice 220 has a smaller (opening) size in the first position as compared to the second position. More specifically, the orifice 220 has a first size (e.g., in terms of diameter) when the gate 222 is in the first position and the orifice 220 has a second size (e.g., in terms of diameter) when the gate 222 is in the second position, and the second size is greater than the first size.

In some implementations, when the gate 222 is in the first position, a sheet 106*a* passing through the orifice 220 pulls the next sheet partially through the orifice 220 before perforating from that next sheet, which allows the next sheet to protrude from the orifice 220 to let a user easily grab it. Thus in this operation the next sheet is partially pulled through the orifice 220 before it perforates from the sheet 106*a* being pulled by the user. To this end, the force applied by the orifice 220 (which at least partially defines the gate 222) on the sheets 106*a* as they pass through the orifice 220 is designed to cause a sheet 106*a* to perforate from the next sheet 106*a* (by exceeding the force required to perforate the sheets) only after the next sheet 106*a* has partially passed through the orifice 220.

In some implementations, this force is applied by friction between the sheet 106*a* and the perimeter of the orifice 220 is based, at least in part, on the diameter (or more generally size) of the orifice 220 and its configuration relative to the size, basis weight and/or composition of the paper 106 passing through it. As such, because the dispenser 100 and product 106 are designed to work together to ensure proper dispensing, the dispenser 100 also discourages unauthorized roll use as rolls not made to the appropriate specifications will either perforate prematurely (e.g., on a regular basis) or not perforate at all.

In some implementations, the dispenser 100 can have interchangeable gates 222 such that a first gate 222 with a first configuration (e.g., matched to the characteristics of a first type of rolled product to promote single sheet dispensing) is interchangeable with a second gate 222 with a second configuration (e.g., matched to the characteristics of a second sheet to promote single sheet dispensing), where the first and second gates 222 have different configurations and the first and second sheets have different characteristics, e.g., size, bulk, etc. The interchangeable gate 222 allows the dispenser 100 to work with different sheets with only changing the gate 222 to match the particular sheet-in-use. For example, the various gates 222 may be press fit into the dispenser 100, e.g., through an interference fit, such as in a snap-in/snap-out fashion or they could mechanically engage the dispenser 100 through a screw-in and screw-out manner.

The dispenser 100 also includes a biasing device 224 that biases the gate 222 towards the first position such that, at rest, the biasing device 224 holds the gate 222 in the first position and, when the gate 222 is moved to the second position, returns the gate 222 to the first position. In some implementations, the biasing device 224 is a spring or other resilient member having a first end attached to the gate 222 and a second end attached to a non-moving part of the dispenser 100. As such, when the gate 222 is moved towards the second position the biasing device 224 is placed into a tensioned (or compressed) state such that it resists the movement towards the second position (e.g., as would happen when a user pushes the gate 222 to the second position to get multiple, interconnected sheets).

However, in some implementations, if not resisted or impeded, the biasing device 224 could return the gate 222 to the first position too quickly (e.g., depending on the configuration of the biasing device 224) and not allow enough time for a user to withdrawal multiple sheets while the gate 222 is in the second position and/or during the return to the first position. To this end, in some implementations, the dispenser 100 includes a dampener 226. The dampener 226 is coupled to the gate 222 and impedes (or resists) the biasing device 224 from biasing the gate 222 towards, and returning the gate 222 to, the first position to delay, in time, the gate 222 from moving from the second position to the first position. This allows, for example, enough time to let a user withdrawal multiple, interconnected sheets at a time before the gate returns to the first position. Although the dampener 226 may resist the force applied by the biasing device 224 to return the gate 222 to the first position, the force applied by the dampener 226 is less than the force applied by the biasing device 224 such that the gate 222 will always return to or proximate the first position.

The dampener 226 can be, for example, a hydraulic or pneumatic dampener, or a spring or other resilient device. For example, the dampener 226 can be a rotational dampener 226 that is connected to the body of the dispenser 100 and mechanically engages the gate 222 (e.g., as shown in FIG. 2B) such that as the gate 222 is moved to the second position the gate 222 rotates the dampener 226 (e.g., via teeth on the gate 222 turning/rotating the dampener 226 in a first direction). As the gate 222 is released from the second position (e.g., by a user), the dampener 226 unwinds and in doing so retards or slows the return of the gate 222 from the second position to the first position, which allows time for a user to withdrawal multiple sheets. In some implementations, the dampener is mounted to the gate 222 and mechanically engages the body of the dispenser 100 such that as the gate 222 is moved to the second position mechanical engagement with the body 102 rotates the dampener 226 (e.g., via teeth on the body turning/rotating the dampener 226).

The delay caused by the dampener 226 slowing the gate 222 from moving from the second position to the first position can be tuned to provide the desired amount of delay, which may be based on, for example, user preference, sheet parameters (e.g., the length of each sheet), the desired number of sheets to be dispensed during multi-sheet dispensing, or some combination thereof. For example, the delay can be set to be in the range between 0.5 and 4 seconds or in the range between 1 and 3 seconds including 1, 2 or 3 seconds. Thus, at a given rate of pulling X (e.g., X>1) sheets through the orifice 220 during the delay, multiple sheets of paper can be dispensed in a continuous stream (i.e., without separating the sheets of the stream). In some implementations, the function of the biasing device 224 and the dampener 226 can be combined into one device or component.

Figure 3:
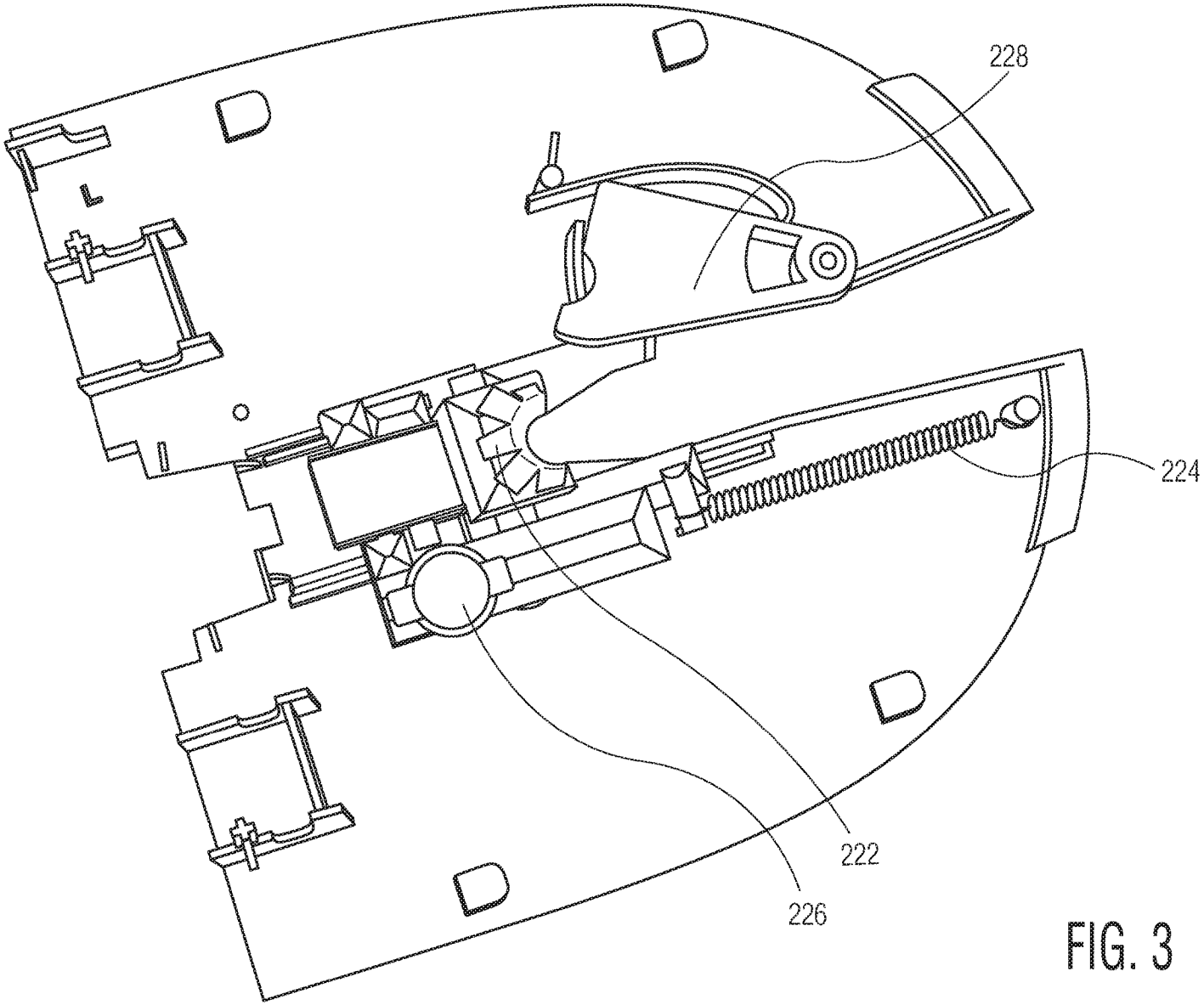
FIG. 3 is a cutaway representation of the dispensing device including the movable door.

In some implementations, the dispenser includes a movable door 228 that (when in a closed positon) defines, at least in part and in combination with the gate 222, the orifice 220, as shown, for example, in FIGS. 2A, 2B and 2C. In some implementations the movable door 228 is connected to the dispenser 100 proximate the gate 222 in a movable manner, for example, through a rotatable hinge or pivot point, to allow the movable door 228 to move been a closed position (e.g., as shown in FIG. 2A) and an open position (as shown in FIG. 3). The movable door 228, when in the open position, allows the series of interconnected sheets to enter the orifice 220 through a side of the orifice 220, as opposed to having to be fed down through the center of the orifice 220. For example, a user can move the moveable door 228 to the open position, and slide the sheets 106 through the opening in the perimeter of the dispenser 100 towards the gate 222, as shown in FIG. 1C. As described above, this facilitates loading of the roll 106 because the user does not have to insert the sheets 106 through the small opening in the orifice 220.

EMBODIMENTS

Embodiment 1. A dispenser for dispensing rolled product having a series of interconnected sheets separated by perforations, the dispenser comprising:

a body having a product holding area for holding the rolled product;

a dispensing device having an orifice defining an opening in the body to the product holding area, a gate configured to move between a first position and a second position with respect to the orifice, a biasing device configured to bias the gate towards the first position, and a dampener coupled to the gate and configured to impede the biasing device from biasing the gate towards the first position to delay, in time, the gate from moving from the second position to the first position; and wherein:

in the first position the gate frictionally engages the series of interconnected sheets passing through the orifice with enough force to break a perforation separating two contiguous sheets of the series to cause single sheet dispensing; and the delay allows multiple sheets of the series of interconnected sheets to pass through the orifice, when pulled at a given rate, before the gate moves from the second position to the first position.

Embodiment 2. The dispenser of embodiment 1, wherein the biasing device is a spring.

Embodiment 3. The dispenser of any preceding embodiment, wherein the dampener is a hydraulic dampener.

Embodiment 4. The dispenser of any preceding embodiment, wherein the delay is between 0.5 and 4 seconds.

Embodiment 5. The dispenser of embodiment 4, wherein the delay is between 1 and 3 seconds.

Embodiment 6. The dispenser of any preceding embodiment, comprising a movable door and wherein the orifice is defined at least in part by gate and the movable door is configured to allow the series of interconnected sheets to enter the orifice through a side of the orifice.

Embodiment 7. The dispenser of embodiment 6, wherein the orifice is defined at least in part by the movable door.

Embodiment 8. The dispenser of any preceding embodiment, wherein the orifice has a first size when the gate is in the first position and the orifice has a second size when the gate is in the second position, and wherein the second size is greater than the first size.

Embodiment 9. The dispenser of any preceding embodiment, wherein the rolled product is paper towels.

Embodiment 10. The dispenser of preceding embodiment, wherein the rolled product is wipers.

Embodiment 11. A method comprising:

moving a gate between a first position and a second position, with respect to an orifice defining an opening in a dispenser body, by overcoming a biasing device biasing the gate towards the first position; and releasing the gate at the second position to allow the gate to return to the first position, wherein the gate's return to the first position is delayed by a dampener coupled to the gate.

Embodiment 12. The method of embodiment 11, comprising removing multiple sheets, from a rolled product in the body, through the orifice during a time defined by the gate moving from the second position to the first position.

Embodiment 13. The method of embodiment 11, comprising removing a single sheet, from a rolled product in the body, through the orifice with the gate in the first position, wherein the gate in the first position provides enough frictional force on the single sheet to break a perforation separating it from a next sheet on the rolled product to cause the single sheet to be dispensed.

Embodiment 14. The method of any of embodiments 11-13, wherein the biasing device is a spring.

Embodiment 15. The method of any of embodiments 11-14, wherein the dampener is a hydraulic dampener.

Embodiment 16. The method of any of embodiments 11-15, wherein the delay is between 0.5 and 4 seconds.

Embodiment 17. The method of embodiment 16, wherein the delay is between 1 and 3 seconds.

Embodiment 18. The method of any of embodiments 11-17, comprising moving a door to an open position to allow a sheet from the rolled product to enter the orifice through a side of the orifice.

Embodiment 19. The method of embodiment 18, wherein the door, in a closed position at least partially defines the orifice.

Embodiment 20. The method of embodiment 19, wherein the gate at least partially defines the orifice.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A dispenser for dispensing rolled product having a series of interconnected sheets separated by perforations, the dispenser comprising:

a body having a product holding area for holding the rolled product;

a dispensing device having an orifice defining an opening in the body to the product holding area, a gate configured to move between a first position and a second position with respect to the orifice, a biasing device configured to bias the gate towards the first position, and a dampener coupled to the gate and configured to impede the biasing device from biasing the gate towards the first position to delay, in time, the gate from moving from the second position to the first position;

wherein:

in the first position the gate frictionally engages the series of interconnected sheets passing through the orifice with enough force to break a perforation separating two contiguous sheets of the series to cause single sheet dispensing; and the delay allows multiple sheets of the series of interconnected sheets to pass through the orifice, when pulled at a given rate, before the gate moves from the second position to the first position; and a movable door and wherein the orifice is defined at least in part by the gate, and the movable door is configured to allow the series of interconnected sheets to enter the orifice through a side of the orifice.

2. The dispenser of claim 1, wherein the biasing device is a spring.

3. The dispenser of claim 1, wherein the dampener is a hydraulic dampener.

4. The dispenser of claim 1, wherein the delay is between 0.5 and 4 seconds.

5. The dispenser of claim 4, wherein the delay is between 1 and 3 seconds.

6. The dispenser of claim 1, wherein the orifice is defined at least in part by the movable door.

7. The dispenser of claim 1, wherein the orifice has a first size when the gate is in the first position and the orifice has a second size when the gate is in the second position, and wherein the second size is greater than the first size.

8. The dispenser of claim 1, wherein the rolled product is paper towels.

9. The dispenser of claim 1, wherein the rolled product is wipers.

10. A method for dispensing a rolled product comprising:

moving a gate between a first position and a second position, with respect to an orifice defining an opening in a dispenser body, by overcoming a biasing device biasing the gate towards the first position;

releasing the gate at the second position to allow the gate to return to the first position, wherein the gate's return to the first position is delayed by a dampener coupled to the gate;

moving a door to an open position to allow a sheet from the rolled product to enter the orifice through a side of the orifice.

11. The method of claim 10, comprising removing multiple sheets, from the rolled product in the body, through the orifice during a time defined by the gate moving from the second position to the first position.

12. The method of claim 10, comprising removing a single sheet, from the rolled product in the body, through the orifice with the gate in the first position, wherein the gate in the first position provides enough frictional force on the single sheet to break a perforation separating it from a next sheet on the rolled product to cause the single sheet to be dispensed.

13. The method of claim 10, wherein the biasing device is a spring.

14. The method of claim 10, wherein the dampener is a hydraulic dampener.

15. The method of claim 10, wherein a delay caused by the dampener is between 0.5 and 4 seconds.

16. The method of claim 15, wherein the delay is between 1 and 3 seconds.

17. The method of claim 10, wherein the door, in a closed position at least partially defines the orifice.

18. The method of claim 17, wherein the gate at least partially defines the orifice.

* * * * *